United States Patent [19]

Fang et al.

[11] Patent Number: 4,812,182

[45] Date of Patent: Mar. 14, 1989

[54] AIR-COOLING LOW-CARBON BAINITIC STEEL

[76] Inventors: Hongsheng Fang; Rufa Zhao; Yankang Zheng; Ziuyun Chen, all of Qinghua University, Beijing; Guangchu He, Second Automobile Factory, Shiyen, Hubei; Jiaoyou Gu, Second Automobile Factory, Shiyen, Hubei; Mingang Zhu, Second Automobile Factory, Shiyen, Hubei; Zhixin Zhang; Keging Tong, both of Panzhihua Iron & Steel Co., Douko, Sichuan, all of China

[21] Appl. No.: 83,130

[22] Filed: Jul. 31, 1987

[51] Int. Cl.[4] ..... C22C 38/14

[52] U.S. Cl. ..... 148/330; 148/12 F; 148/337

[58] Field of Search ..... 148/330, 12 F, 337

[56] References Cited

U.S. PATENT DOCUMENTS

| | | | |
|---|---|---|---|
| 2,280,283 | 4/1942 | Crafts | 75/123 |

FOREIGN PATENT DOCUMENTS

| | | | |
|---|---|---|---|
| 2544858 | 4/1976 | Fed. Rep. of Germany . | |
| 3220890 | 8/1983 | Fed. Rep. of Germany . | |
| 827281 | 4/1982 | France . | |
| 45-21180 | 2/1970 | Japan . | |
| 45-21180R | 7/1970 | Japan . | |
| 47-46645 | 4/1972 | Japan . | |
| 47-6645R | 11/1972 | Japan . | |
| 49-37173 | 3/1974 | Japan . | |
| 49-70167 | 6/1974 | Japan . | |
| 4453571 | 10/1974 | Japan . | |
| 023422 | 9/1975 | Japan . | |
| 49-023422 | 9/1975 | Japan . | |
| 003212 | 8/1976 | Japan . | |
| 53-043884 | 1/1978 | Japan . | |
| 53-08981 | 8/1978 | Japan . | |
| 0043884 | 11/1978 | Japan . | |
| 8043884 | 11/1978 | Japan . | |
| 0009966 | 4/1979 | Japan | 148/330 |
| 037820 | 8/1979 | Japan . | |
| 54-023883 | 8/1979 | Japan . | |
| 54-171594 | 12/1979 | Japan . | |
| 55-35884 | 3/1980 | Japan . | |
| 55-37028 | 3/1980 | Japan . | |
| 55-84998 | 6/1980 | Japan . | |
| 0091935 | 7/1980 | Japan | 148/330 |
| 56-17950 | 10/1981 | Japan . | |
| 156092 | 4/1983 | Japan . | |
| 8058253 | 4/1983 | Japan . | |
| 0077531 | 5/1983 | Japan | 148/330 |
| 59-138276 | 7/1984 | Japan . | |
| 59-260839 | 7/1984 | Japan . | |
| 2163454A | 2/1986 | United Kingdom . | |

OTHER PUBLICATIONS

Fang et al, Acta Metall Sin. (China) A283–A288, 1986.

Fang et al, "The Strength and Toughness of the Air--Cooled Microstructure of Medium Carbon Bainite/-Martensite Dual Phase," Trans. Met. Treat. (China) (1) 10–18, 1986.

Fang et al, "Heat Treat. Met." (China) (9) 3–8, Sep. 1985.

Bai et al, Transformation of Granular Bainite in Low--Carbon Alloy Steels, Trans. Met. Heat Treat. (China), 5, (2), 15–34, Dec. 1984.

*Primary Examiner*—Upendra Roy

*Attorney, Agent, or Firm*—John R. Pegan

[57] ABSTRACT

Steel articles have a granular bainite microstructure on continuous air cooling, from hot working temperature, of a low cost, tough, high strength, low alloy (HSLA) steel having a composition which, in broadest scope, scope, consists essentially, by weight percent, of 0.08 to 0.25% carbon, 0.30 to 1.5% silicon, 2.0 to 3.2% manganese and 0.005 to 0.005% boron. The steel composition preferably contains, in one aspect of the invention: 0.08 to 0.18% carbon, 0.3 to 1.2% silicon, 2.1% to 2.5% manganese and 0.005 to 0.004% boron; and in another aspect: 0.08 to 0.18% carbon 0.7 to 1.2% silicon, 2.7 to 3.1% manganese, and 0.0005 to 0.004% boron. The steel optionally may contain, by weight percent: up to 0.10 calcium and up to.0.20%, preferably less than 0.01%, sulfur, or up to 0.10% lead; up to 0.10%, especially 0.04 to 0.10%, vanadium, and up to 1.5% chromium. The steel is substantially free of molybdenum, tungsten and other alloying elements, except for residual amounts.

11 Claims, 2 Drawing Sheets

AIR-COOLING LOW-CARBON BAINITIC STEEL

BACKGROUND OF THE INVENTION

Figure 1:
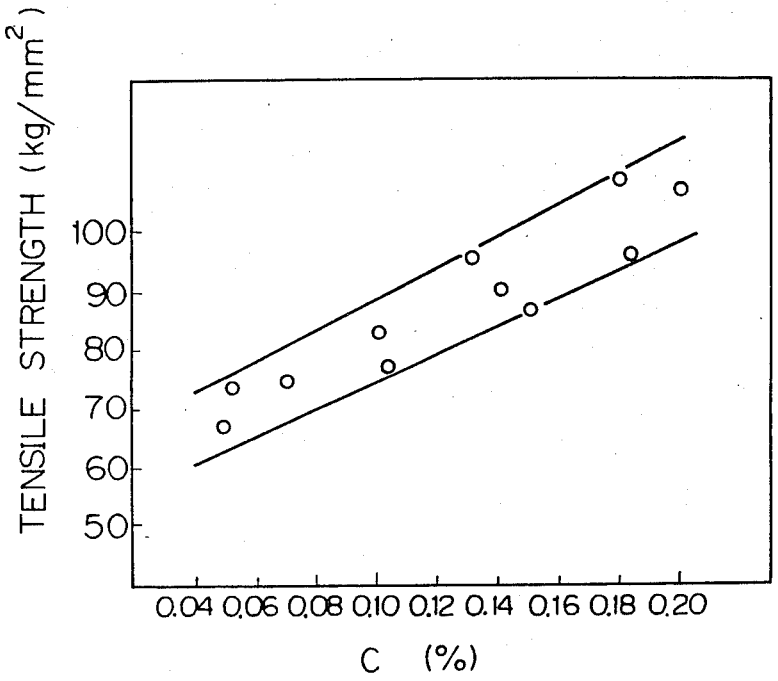
Figure 2:
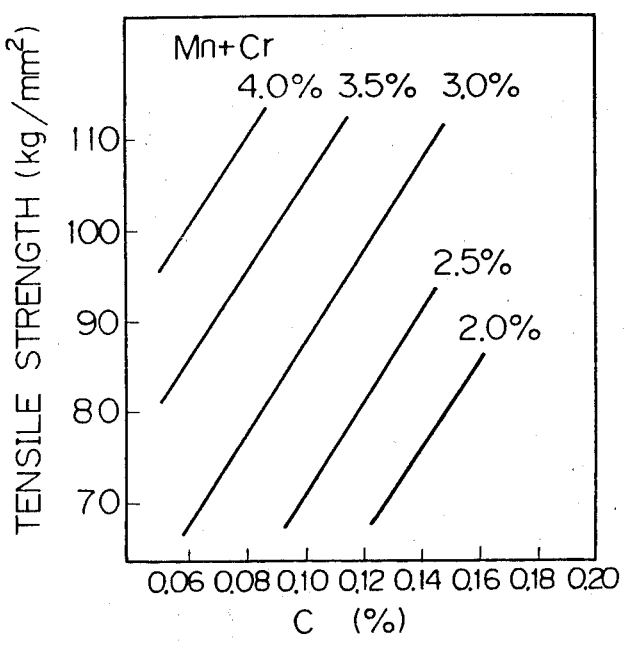
Figure 3:
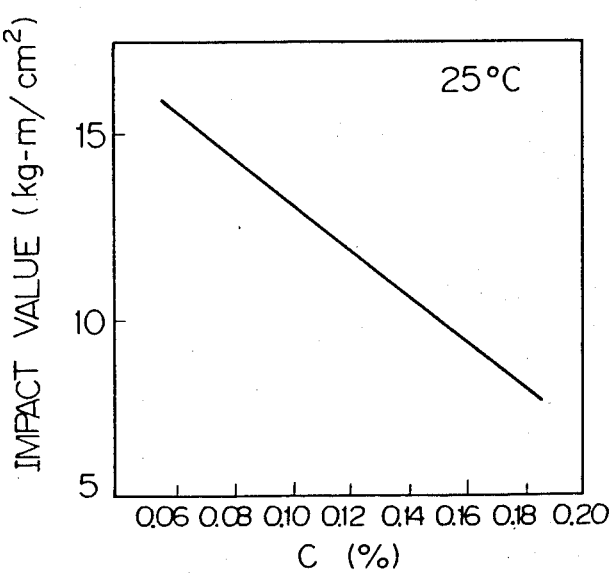

Previously, molybdenum and/or tungsten have been necessary alloying elements to provide a bainitic structure in steels under continuous air cooling conditions. Such alloying elements are scarce and expensive. Consequently such costly prior art bainitic steels, for example those containing molybdenum or molybdenum and boron, have found only limited commercial application.

Recently there have been developed ferrite/martensite and lower bainite/martensite dual phase steels, alloyed with Mo, Nb, V, Ti, B and rare earth metals (REM), produced by controlled-rolling or continuous annealing in the ferrite/austenite two-phase region after rolling. Such steels present practical problems such as the need for special equipment, complex manufacturing processes, and associated high production cost as well as high materials cost.

The present invention provides economical, tough, high strength low alloy (HSLA) C-Si-Mn-B steels having a bainitic microstructure on air cooling from a hot working temperature.

SUMMARY OF THE INVENTION

The steels of this invention are free of scarce, high cost alloying elements such as Mo and W, and, in addition to limited amounts of carbon, consist essentially only of the low cost elements silicon, manganese boron, etc. in amounts and proportions carefully balanced so as to provide a granular bainitic microstructure exhibiting good combination of strength and toughness after continuous cooling in air from hot working.

The steels of this invention can be smelted in oxygen-blown convertors or in electric furnaces and can be continuously cast or cast into ingots by conventional ingot pouring practices. The steels can be applied to the fabrication of a variety of articles by hot or cold working, either directly, without either quenching or tempering, or after tempering (without the necessity for prior quenching).

An important feature of this invention is freedom from the need for quenching treatment or any particular cooling control technique in the manufacture of tough, high strength steel articles. Advantages include reduction in defects such as cracking and decarbonization due to quenching, avoidance of the costs of special production equipment, and savings in time and energy costs.

Composition of the steels of this invention is maintained within the broad element ranges, in weight percent, as set out in the following Table 1:

TABLE 1

| Element | Amount |
|---|---|
| carbon | 0.08 to 0.25 |
| silicon | 0.30 to 1.50 |
| manganese | 2.0 to 3.2 |
| boron | 0.0005 to 0.005 |

Preferred ranges, in weight percent, are given in Table 2 as follows:

TABLE 2

| Element | |
|---|---|
| carbon | 0.08 to 0.18 |
| especially | 0.08 to 0.20 |
| silicon | 0.3 to 1.2 |

TABLE 2-continued

| Element | |
|---|---|
| manganese | 2.1 to 2.5 |
| boron | 0.0005 to 0.004 |

The above described basic compositions additionally may contain one or more of the following elements, by weight percent of the steel composition, as shown in the following Table 3:

TABLE 3

| Element | Amount | Amount |
|---|---|---|
| vanadium | 0.10 maximum | 0.04 to 0.10 |
| titanium | 0.04 maximum | 0.025 maximum |
| calcium | 0.10 maximum | 0.10 maximum |
| sulfur | 0.20 maximum | 0.10 maximum |
| lead | 0.10 maximum | 0.10 maximum |
| chromium | 1.50 maximum | 1.50 maximum |
| aluminum | 0.04 maximum | 0.025 maximum |

Vanadium is well-known as a carbide and nitride forming and grain refining element in high manganese HSLA steels. When present in amounts of 0.04% up to the specified maximum, vanadium is especially useful in the inventive steels requiring highest strength and toughness, such as automotive parts, for example axles and connecting rods, which, after air cooling, may be subjected to a tempering treatment resulting in the precipitation of fine vanadium carbides and/or nitrides.

Sulfur may be included, within the specified broad limit thereof, to enhance machinability of the new steels. Calcium is a useful addition to aid in control of the shape of inclusions such as manganese sulfides and thereby to provide enhanced machinability and surface quality. For applications where machinability is less important, sulfur preferably is limited to less than 0.01%. According to known principles, lead may be used as a free machining additive in place of sulfur.

Chromium optionally may be included in the specified maximum amount for its known effects in improving hardening, strengthening and atmospheric corrosion resistance.

Expensive rare earth metals, or other oxidizers such as aluminum or titanium, if present in amounts substantially larger than those specified, could interfere with the proper production of the new steels or their desired properties. For example, the presence of aluminum or titanium in such larger amounts could form undesirable oxides which would make it difficult or impossible to continuously cast the new steels due to oxide clogging of the molten steel teeming control equipment.

Except for boron and, optionally, vanadium, the steels of this invention also are free of substantial amounts of nitride forming elements. We avoid the use of substantial amounts of powdeful nitride formers such as titanium which would impair the toughness of the steels processed without special rolling and heat treatment practices. The boron content of the inventive steels is maintained within a range sufficient for exertion of its desired alloying effects in normal steelmaking practice. A small amount of titanium can be tolerated and may be beneficial in protecting against the reaction of boron with excessive amounts of dissolved nitrogen. For such purposes a maximum of 0.04% titanium may be present, which would provide a residual level of about 0.02% maximum alloying titanium in the steel after that element, and/or vanadium in case of the vanadium-containing steels, combines to form nitrides, oxides and/or carbides. For proper balance of strength and toughness, in some steels we prefer to limit titanium to 0.025%.

Steel compositions within the preferred range of Table 2 exhibit properties as given in Table 4.

TABLE 4

| Property | Steel Condition: air cooled only | Steel Condition: after tempering (at a suitable temperature from 200–650° C.) |
|---|---|---|
| yield strength, kg/mm$^2$ | over 50 | over 50 |
| tensile strength, kg/mm$^2$ | over 75 | over 70 |

Table 5 provides specific examples of steels having manganese contents within these respective more limited amounts within the broad range of Table 1.

TABLE 5

| Steel | Composition, wt. % C | Si | Mn | B | V |
|---|---|---|---|---|---|
| 1 | 0.12 | 0.81 | 2.6 | 0.003 | — |
| 2 | 0.21 | 0.48 | 2.4 | 0.0028 | — |
| 3 | 0.12 | 0.71 | 2.9 | 0.003 | — |
| 4 | 0.15 | 0.65 | 2.2 | 0.0022 | 0.10 |

Pipe blanks of the steels having compositions of Examples 1 and 3 of Table 5 were hot rolled and then punched into 77 mm or 102 mm diameter pipes. The same steels also were directly rolled into reinforcing bars of less than 18 mm diameter exhibiting a granular bainite structure. After air cooling from hot working, the higher manganese steels 1 and 3 of Table 5 were found to have an 0.2% off-set yield strength over 80 kg/mm$^2$, and a value somewhat less than that figure was obtained for the lower manganese steel of example 2 of Table 5. In each case the steels had good fatigue properties, at least comparable to those exhibited by known steels used for similar purposes.

It is apparent that the inventive steels require only relatively modest amounts of inexpensive alloying elements. In addition to materials cost savings, lower capital equipment costs, and time- and energy-related operating savings, further savings can be realized in the cost of producing reinforcement rod because cold drawing procedures necessary for producing reinforcing rod from previously used steels can be omitted. Thereby, production costs may be decreased by about 20% for example under Chinese production conditions.

Accordingly, the new steels can be substituted for steels previously used for the production of reinforcement bar, such as 40Si2V (0.4C-2Si-0.06/0.12V), 44Mn2Si (0.44C-0.2Mn-1Si), 45Si2Ti (0.45C-2Si-Ti) and 45MnSiV (0.45C-1Mn-1Si-0.06/0.12V) steels having about 60 kg/mm$^2$ 0.2 offset yield strength and 90 kg/mm$^2$ tensile strength. Thus, in addition to the materials and operating cost savings achievable in manufacture of reinforcing rod from the new steels, their high mechanical properties also afford a basis of savings in the form of decreased amounts of reinforcing steel and concrete needed for particular construction requirements.

Illustrating the properties and utility of the vanadium-containing steels of the invention, 85 mm and 50 mm square blanks having the composition of Example 4 of Table 5 die-forged into automotive axles and connecting rods, air-cooled and then tempered. Such bar products, having a maximum product section of about 30 mm after final forging, upon air-cooling, exhibit the desired granular bainite structure. In such condition, this steel had an 0.2% off-set yield strength over 50 kg/mm$^2$.

Table 6 shows the bending fatigue endurance limit of automotive axles so produced, and a property comparison of such articles with similar articles made from a carbon steel previously used for such purpose.

TABLE 6

Bending Fatigue of Auto Front Axles

| Steel | Test Load, kg. $P_{max}$ | $P_{min}$ | Endurance Limit, number of cycles $N \times 10^{-6}$ |
|---|---|---|---|
| this invention | 8400 | 800 | 1.25; 1.68; 0.97 |
| AISI 1045(1) | 8400 | 800 | 0.35; 0.42; 0.53; 0.47 |

(1)Composition: 0.43/0.50% C, 0.70/1.0% Mn, 0.04% P, 0.05% S.
(2)Heat Treatment: Axles were quenched at 840 deg. C. and tempered at 640 deg. C.

Heat Treatment: Axles were quenched at 840 deg. C. and tempered at 640 deg. C.

From Table 6, it is evident that the air-cooled and tempered steels of the invention provided bending fatigue limits from about two to four times greater than the comparison carbon steel previously used for this application.

Table 7 shows the tensile fatigue properties of the automotive connecting rods so produced, and a comparison of such properties with those exhibited by similar articles made from manganese or manganese/boron steels previously used for such purposes.

TABLE 7

Tensile Fatigue of Auto Connecting Rods

| Steel | Test Load, kg | Endurance Limit Cycles $\times 10^{-6}$ |
|---|---|---|
| this invention | 7000 | 0.0336; 1.266; 1.105; 0.665; 0.442 |
| 40 Mn(1) | 7000 | 0.246; 0.303; 0.186; 0.338; 0.284; 0.245 |
| 40 MnB(2) | 7000 | 0.351; 0.333; 0.267; 0.509; 0.336; 0.192 |

(1)Composition: 0.40C—lMn.
(2)Composition: 0.40C—lMn—B. Heat Treatment: quenched at 840 deg. C. and tempered at 600 deg. C.

Heat Treatment: quenched at 840 deg. C. and tempered at 600 deg. C.

Significantly longer endurance limits were exhibited by the steels of this invention as compared to the previously used steels.

Selection of particular time and temperature conditions for tempering the steels of the invention depends upon the composition and dimensions of the article being tempered, and upon the desired properties as affected by the tempering operation. Tempering of articles of these bainitic steels is optional, for added tougness, since not all such articles require this heat treatment and corresponding enhancement of toughness over that of the untempered steels. The tempering temperature range is from about 200 deg. C. to 650 deg. C. Hot working temperature depends largely upon the characteristics, such as the dimensions, of the product being worked. A suitable finishing temperature for the hot working operation is in the range of 850 deg. C. to 1050 deg. C. Selection of specific conditions of tempering temperature and time, and hot working temperature within these ranges can readily be made by those skilled in the art.

Steels having the compositions as described in the foregoing Tables exhibit hardnesses from Brinell 220 to 350 in the air cooled condition—a value which is difficult to achieve in other low alloy steels without addition of other expensive alloying materials and/or special heat treatments.

These superior properties of the new high strength, low alloy bainitic steels as compared to commonly used carbon steels, and their relatively low cost and good mechanical properties as compared with expensively alloyed steels or those requiring special, complex production or fabrication techniques admirably suit these new steels to a wide variety of practical commercial applications where these properties and favorable economics are required.

We claim:

1. A forged steel article in the form of an elongated bar having a maximum cross-section dimension in a plane normal to the length of the bar at least about 30 mm. and having a principally granular bainite microstructure and a Brinell hardness of at least 220 and up to 350 upon air cooling the article to room temperature after hot working from a finishing temperature in the range from 850 deg. C. to 1050 deg. C. and wherein the steel consists essentially, by weight percent, of:

carbon 0.08 to 0.25%,
silicon 0.30 to 1.50%,
manganese 2.0 to 3.2%,
boron 0.0005 to 0.005%,
vanadium up to 0.10%,
titanium up to 0.04%,
sulfur up to 0.20%,
calcium up to 0.10%,
aluminum up to 0.025%,
chromium up to 1.5%, and
iron balance, except for incidental steelmaking impurities.

2. An article according to claim 1 wherein the steel contains carbon 0.08 to 0.20%,
silicon 0.30 to 1.2%,
manganese 2.1 to 2.5%, and
boron 0.0005 to 0.004%.

3. An article according to claim 1 wherein the steel contains carbon 0.08 to 0.18%,
silicon 0.30 to 1.2%,
manganese 2.1 to 2.5%, and
boron 0.0005 to 0.004%.

4. An article according to claim 1 wherein the steel contains carbon 0.08 to 0.18%,
silicon 0.7 to 1.2%,
manganese 2.7 to 3.1%, and
boron 0.0005 to 0.004%.

5. An article according to claim 1 wherein the steel is substantially free of calcium, contains less than 0.02% sulfur, and further contains lead in an amount not exceeding 0.10 weight percent.

6. A forged bar article according to claim 1 wherein, after finish working the article at a temperature from 850 deg. C. to 1050 deg. C. and air cooling, the steel has an 0.2% offset yield strength of at least 50 ky/mm$^2$ and a tensile strength of at least 70 kg/mm$^2$.

7. An article according to claim 4 wherein, after air cooling, the steel has an 0.2% offset yield strength of at least 80 kg/mm$^2$ and a tensile strength of at least 110 kg/mm$^2$.

8. An article according to one of claims 1–3 and 4 wherein, after air cooling, the article is tempered at a temperature from 200 deg. C. to 650 deg. C.

9. An article according to one of claims 1–3 and 4 in the form of a structural reinforcing rod.

10. An article according to one of claims 2 and 3 in the form of an automotive axle which, after air cooling following finish forging, is tempered at a temperature from 200 to 650 deg. C.

11. An article according to one of clims 2 and 3 in the form of an automotive connecting rod which, after air cooling following finish forging, is tempered at a temperature from 200 to 650 deg. C.

* * * * *